US005556225A

United States Patent [19]

Marino

[11] Patent Number: 5,556,225

[45] Date of Patent: Sep. 17, 1996

[54] METHOD FOR REPAIRING ASPHALT PAVEMENT

[75] Inventor: Frederick W. Marino, Swampscott, Mass.

[73] Assignee: Felix A. Marino Co., Inc., Peabody, Mass.

[21] Appl. No.: 388,250

[22] Filed: Feb. 14, 1995

[51] Int. Cl.[6] ..... E01C 21/00

[52] U.S. Cl. ..... 404/77; 404/80; 404/82

[58] Field of Search ..... 404/27, 31, 75, 404/77, 79, 80, 81, 82, 111, 78

[56] References Cited

U.S. PATENT DOCUMENTS

| | | | |
|---|---|---|---|
| 940,971 | 11/1909 | Howe | 404/81 |
| 3,162,101 | 12/1964 | Rostler | 94/23 |
| 3,199,423 | 8/1965 | Dickey | 404/111 |
| 3,386,435 | 6/1968 | Heller | 126/343.5 |
| 3,577,976 | 5/1971 | Heller | 126/343.5 |
| 4,094,697 | 6/1978 | Rostler | 106/280 |
| 4,418,682 | 12/1983 | Heller | 126/343.5 |
| 4,445,848 | 5/1984 | Heller | 432/13 |
| 4,630,963 | 12/1986 | Wyman | 404/75 |
| 4,708,516 | 11/1987 | Miller | 404/31 |
| 4,744,693 | 5/1988 | Smith | 404/77 |
| 4,815,891 | 3/1989 | O'Connor | 404/77 |
| 5,026,206 | 6/1991 | O'Connor | 404/77 |
| 5,047,143 | 9/1991 | Carlson | 208/428 |
| 5,092,706 | 3/1992 | Bowen et al. | 404/77 |
| 5,362,178 | 11/1994 | Schantz | 404/111 X |

OTHER PUBLICATIONS

O'Connor, P., Message from the President of Thermal Power Corporation.

Thermal Power Corporation, "Specifications for Asphalt Pavement Repair Patch Master Method", 1986.

*Primary Examiner*—Tamara L. Graysay
*Assistant Examiner*—James A. Lisehora

[57] ABSTRACT

The present invention provides an improved method of immediately repairing multiple backfilled utility cut trenches, potholes, and other discontinuities in asphalt pavement, at any ambient temperature, in which the pavement discontinuity is bridged by layers of heated virgin bituminous concrete of different grades, each layer including aggregate stone mixed with a liquid asphalt binder. Alternatively, substantially non-polymerized thermoplastic bituminous concretes of different grades may be used to form the bridging layers, each layer including aggregate stone mixed with a liquid asphalt binder and preferably also containing fractions of n-pentane soluble asphalts and being repetitively softenable in response to repetitive applications of infrared radiation. Also provided is a self-contained mobile unit for heating, storage, and delivery of required asphaltic material comprising two asphalt reclamation units.

13 Claims, 5 Drawing Sheets

METHOD FOR REPAIRING ASPHALT PAVEMENT

BACKGROUND OF THE INVENTION

The present invention relates to an improved method for repairing asphalt pavement roads containing utility cut trenches, potholes, and other discontinuities.

Utility companies must frequently cut trenches into roads and sidewalks in order to place new utility lines or to repair existing defective utility lines. Such openings are commonly designated as "utility cuts." After placement or repair of utility lines, the trench must be backfilled with a material which will ultimately support a patch in the overlying pavement. Similarly, potholes and other discontinuities in roads and sidewalks require repair, sometimes frequently. Repair and maintenance of utility cuts, potholes, and other pavement discontinuities drain resources away from the responsible governmental authority and ultimately from taxpayers.

When utility cuts are repaired, a "temporary patch" is generally placed over the backfilled trench. Commonly used backfills include the subbase materials excavated from the trench, light strength concrete, manufactured and natural gravel, soil cements, and the like. In prior art repair methods, gravel backfill must be compacted and soil cements must "set", i.e. consolidate or settle, prior to placement of the temporary patch. The underlying ground layer is allowed to consolidate or settle for a period of time, which may vary from about thirty days to about a year. All backfill materials may consolidate and/or settle over time. The temporary patch is then excavated, using a jackhammer, saw, or the like, and any surface irregularities, such as those resulting from settlement and/or consolidation which has occurred are corrected. The temporary patch is then replaced by a permanent patch.

An improved method of patching asphalt pavement, useful only when compacted soil cement is the backfill material (the PatchMaster™ method), eliminates the need to excavate the temporary patch by setting the surface of the soil cement with heat, scarifying the surrounding patch and bonding additional (single gradation) asphalt concrete to the heated area. However, the PatchMaster™ method is limited in its utility. The amount of time required to set soil cement backfill by heat limits the size and number of utility cuts which can be repaired using known Mating equipment. Most bituminous concrete pavements are formed of base and top layers having separate and distinct gradations of bituminous concrete for each layer. The PatchMaster™ method does not restore the original structure of such asphalt pavements, i.e., the separate base and top layers. Moreover, the PatchMaster™ method does not compensate for consolidation and/or movement of the backfill and surrounding subbase formed by the earth or ground underlying the patch, which occurs as a normal result of thermal expansion and contraction, of shrinkage of the soil cement backfill, or of traffic on the pavement.

Conventional temporary patches are installed directly over the backfilled trench. This practice is not substantially changed by the PatchMaster™ method. Consequently, the boundary of the patch substantially overlies the boundary of the trench and the patch has no contact with the undisturbed solid ground surrounding the excavated area. In such instances, the patching materials used in the patch bonds with the vertical edge of the existing asphalt pavement where the patch boundary and existing pavement interface, by virtue of the nature of asphaltic materials. In the PatchMaster™ method the existing vertical edge is merely heated and loosened. At a later date, the temporary patch may (or may not)be excavated and replaced with a permanent repair sometimes enlarging the interfacing area, occurring around the original perimeter of the temporary patch. When the temporary patch is not excavated, the interfacing area remains relatively small, occupying substantially the area over the original trench, representing an inherent structural weakness. Even when the gravel backfills are compacted, and/or soil cements are set, the possibility of further consolidation of the ground underlying the permanent patch remains, since it is not possible to compensate completely for the differential of movement in the backfilled area as opposed to the surrounding subbase or subgrade, resulting from the initial disturbance by excavation of the utility cut. The lack of contact between the patch and solid ground in such circumstances creates inherent weakness that is amplified by the use of single gradation bituminous concrete in conventional temporary and sometimes in permanent patches.

The need remains, therefore, for improved temporary and/or permanent repair methods for asphaltic pavement which has been subjected to utility cuts or which contains potholes or other discontinuities.

It is an object of the present invention to provide an improved method and apparatus for effecting repair of utility cuts, potholes, and the like in asphaltic pavement.

SUMMARY OF THE INVENTION

The present inventor has developed a way to immediately apply an asphalt patch in all climates, throughout the year, in such a manner that the patch includes at least one large aggregate (base) layer of a virgin or substantially non-polymerized bituminous concrete including relatively large aggregate which bridges the utility cut trench, pothole, or other pavement discontinuity, and at least one small aggregate (surface) layer of a virgin or substantially non-polymerized bituminous concrete including relatively small aggregate overlying the uppermost large aggregate layer, significantly strengthening the structure and stability of the patch and restoring the pavement approximately to its original condition. When asphalt pavement patches are made in accordance with the present invention, the need to excavate temporary patches and replace them with permanent patches is eliminated entirely, yielding a new category of "semi-permanent" patch which does not require re-excavation and which is substantially completely heat recyclable if further surface alteration is desired. The method of the present invention may be used with any kind of conventional backfill material. The method of the present invention further does not require that backfill be compacted prior to application of the patch, and thus is not limited to use of soil cement as backfill. The nature, depth, and strength of the materials used in the method of the invention render the repaired area "pothole proof" and allows for future surface heat recycling, if required.

In one embodiment, the invention provides a method of repairing asphalt pavement over a trench containing backfill and characterized by a peripheral wall defining the trench, comprising the sequential steps of: a) cutting back the pavement to provide a region overlying the trench and extending beyond the peripheral wall; b) applying at least one large aggregate layer in said region, whereby the peripheral wall of the trench is bridged; c) applying at least one small aggregate layer overlying the uppermost large aggregate layer; and d) applying heat to the uppermost layer of at least one of said large aggregate layers and said small aggregate layers; said large aggregate layer being a heated virgin first bituminous concrete including relatively large aggregate mixed with a liquid asphalt binder, or a substantially non-polymerized thermoplastic first bituminous concrete including a relatively large aggregate mixed with a liquid asphalt binder containing n-pentane soluble fractions of asphalts and being repetitively softenable in response to repetitive applications of infrared radiation, and said small aggregate layer being a heated virgin second bituminous concrete including a relatively small aggregate mixed with a liquid asphalt binder, or a substantially non-polymerized thermoplastic first bituminous concrete including a relatively small aggregate mixed with a liquid asphalt binder containing n-pentane soluble fractions of asphalts and being repetitively softenable in response to repetitive applications of infrared radiation, whereby a patch is formed. The patch made in accordance with the invention essentially conforms with the original texture and contour of the surrounding pavement.

In another embodiment, the invention provides a single mobile self-contained unit for heating, storage, and delivery of all asphaltic materials in any climate throughout the winter season (when conventional asphalt plants traditionally close in cold weather), which comprises two separate asphalt reclamation units.

BRIEF DESCRIPTION OF THE DRAWINGS

The foregoing and other objects of the invention, the various features thereof, as well as the invention itself, may be more fully understood from the following description, when read together with the accompanying drawings in which.

DESCRIPTION OF THE PREFERRED EMBODIMENTS

Figure 1:
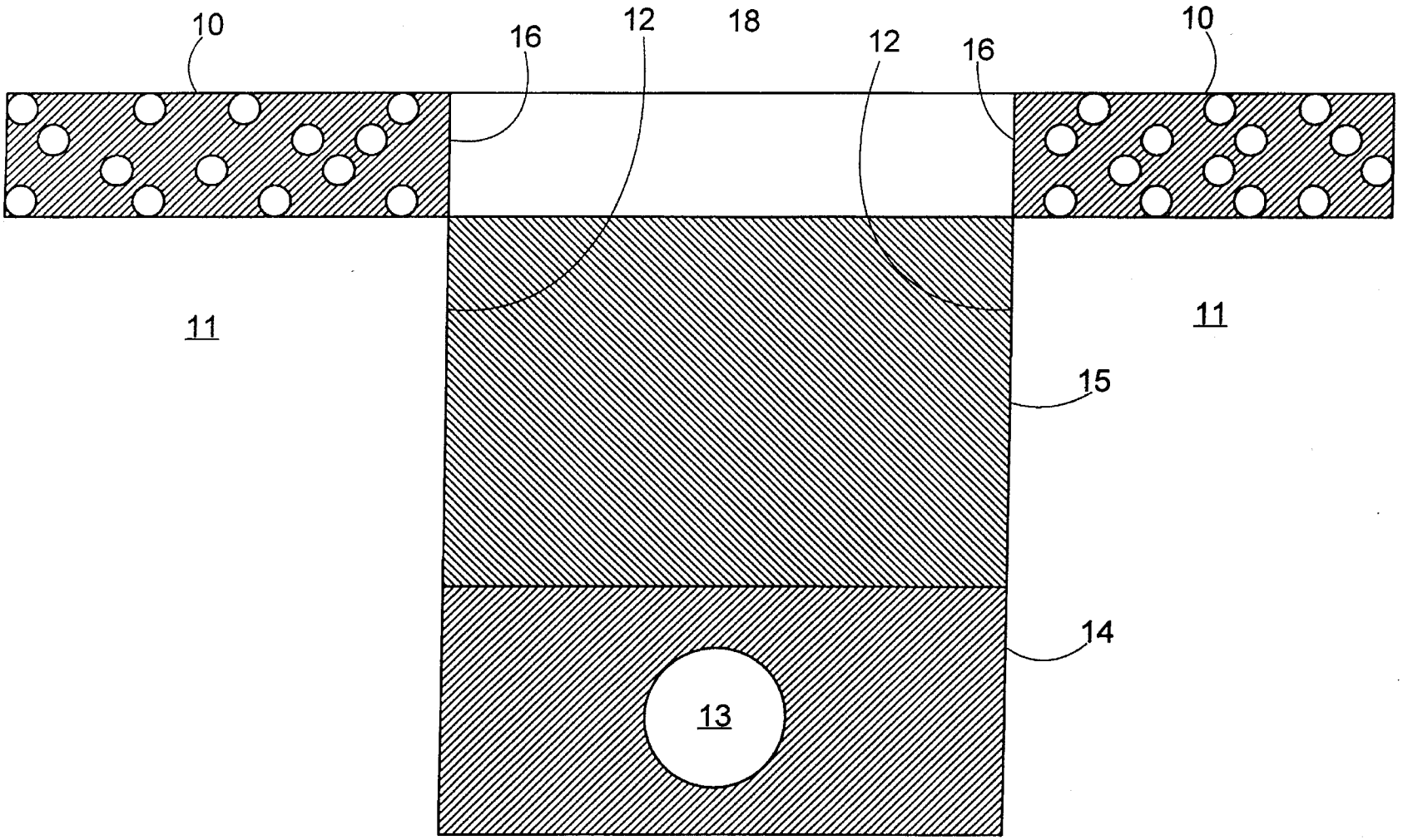
FIG. 1 shows a sectional view of a road containing a conventional backfilled utility trench prior to application of the method of the invention.

FIG. 1 shows a road in which pavement 10 overlies the ground 11. A hole 18 in the pavement overlies a utility trench, excavated to perform repairs on a utility pipe 13. A utility cut trench is defined by peripheral walls 12 after backfilling. Any conventional backfill material may be used in accordance with the present invention, including light strength concrete, soil cement, manufactured gravel, and the like. In accordance with the invention, the term "backfill" includes subgrade or subbase as those terms are understood in the art. The utility pipe 13 may be surrounded by a non-abrasive small particle bedding material 14, such as sand, over which backfill 15 can be placed. In accordance with the present invention, the bedding material 14 may also be comprised of backfill itself. The boundary 16 of the hole in the pavement 10 overlies the peripheral walls 12 of the trench. In accordance with the method of the invention, the backfill material is not restricted to soil cements commonly referred to as Controlled Density Fill (CDF); however, gravel backfills are optimally compacted prior to the first step of the method. When the method of the invention is used to repair potholes or trenches in which subgrade consolidation has occurred, a preheating step may be included prior to the first step to thermally enhance the bonding of the bituminous concrete patch with the existing pavement.

Figure 2:
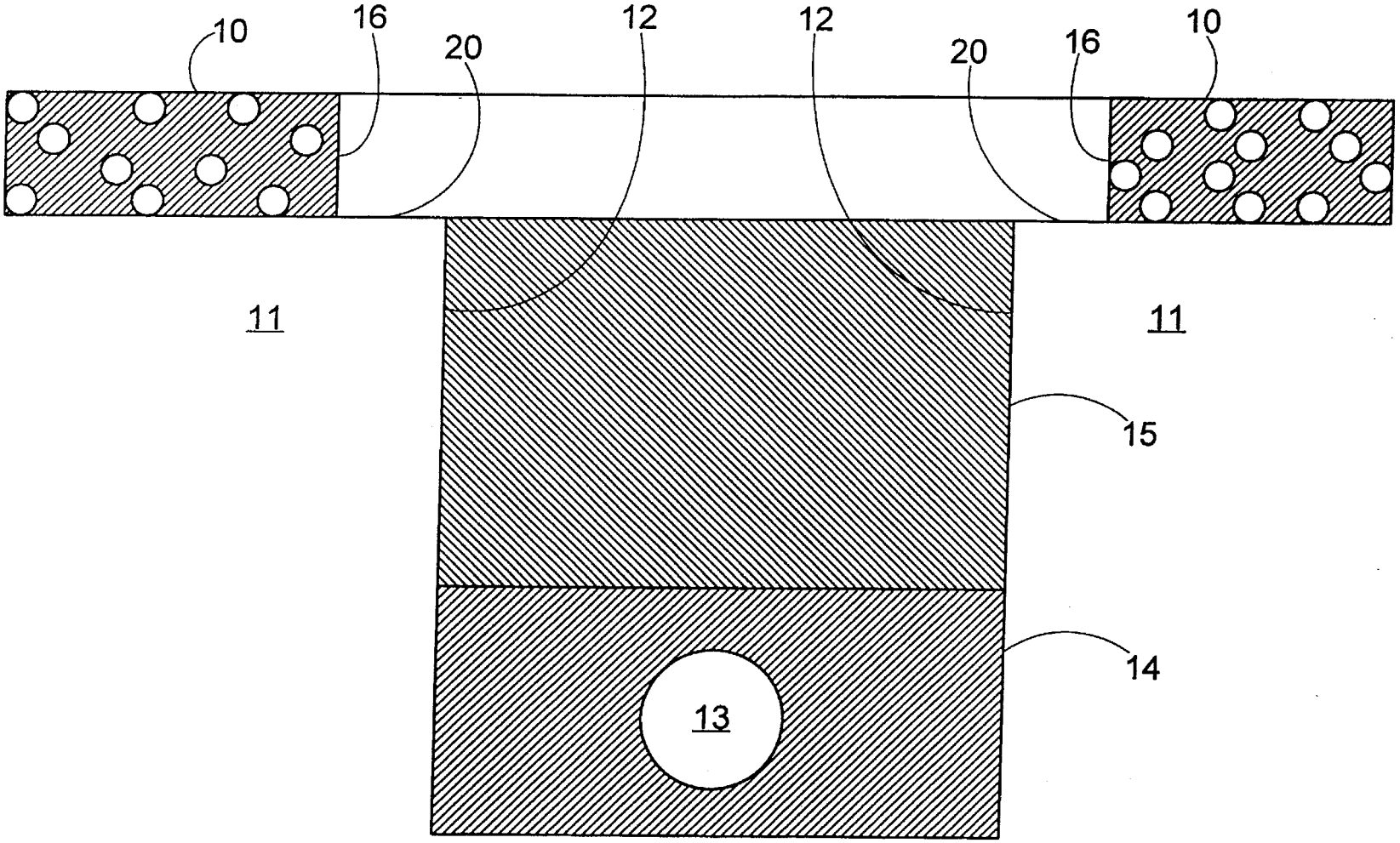
FIG. 2 shows a sectional view of the backfilled utility trench of FIG. 1 with cut back pavement, prior to application of the large aggregate base layer of the invention.

FIG. 2 shows the first step of the method of the invention, in which the pavement 10 has been cut back to provide a surface region 20 of solid ground 11 extending beyond the peripheral walls 12 of the trench. In accordance with the invention, region 20 may be bounded by walls 16 in the form of a substantially square vertical surface, or it may gradually incline from the point of cutback toward the surface of the pavement 10. The cuts in the pavement 10 are made to extend to the solid ground 11 surrounding the trench, beyond the peripheral walls 12 of the trench so as to form a "bridge" of the binder layer across the trench. At a minimum, the cuts in the pavement are made to extend slightly beyond the peripheral walls of the trench, so long as formation of the "bridge" of binder layer across the trench is allowed. Preferably, the pavement 10 is cut back approximately 12 inches beyond the peripheral walls of the trench. In accordance with the invention, the binder layer is comprised of one or more large aggregate base layers and of one or more small aggregate surface layers.

Figure 3:
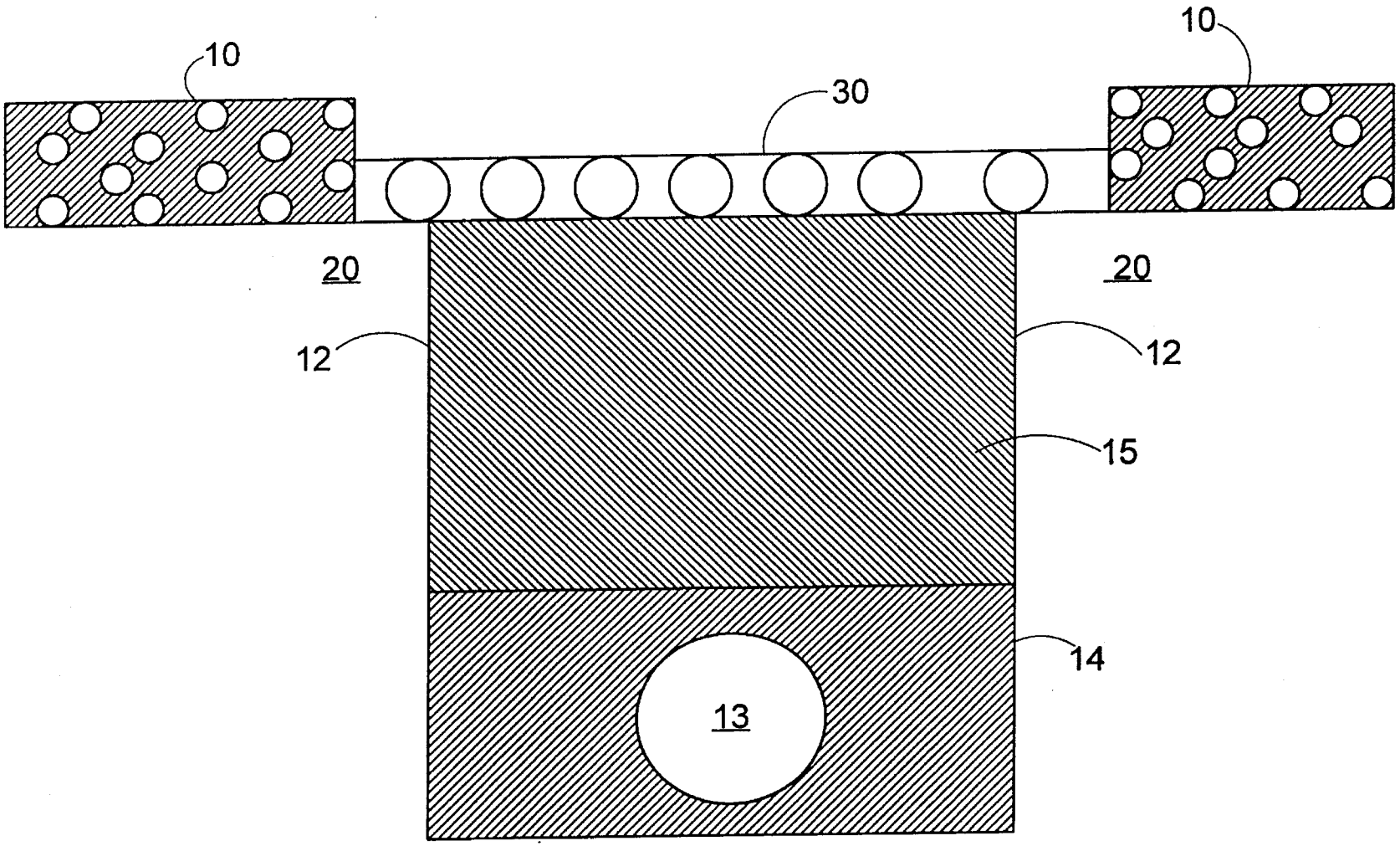
FIG. 3 shows a sectional view of the backfilled utility trench of FIGS. 1 and 2 with the binder layer applied in accordance with the method of the invention, bridging the peripheral wall of the trench.

FIG. 3 shows the second step of the method of the invention, in which a large aggregate foundational or base layer 30 has been applied over the region 20 and across the backfill 15, in such a way that the peripheral wall 12 of the trench has been bridged. The large aggregate base layer 30 is comprised of a coarse grade of a heated virgin bituminous concrete including relatively large particles of stone, i.e., relatively large aggregate, mixed with liquid asphalt binder (asphalt cement, emulsified asphalt, or the like). In accordance with the invention, the large aggregate contains particles of stone having a maximum dimension in the range of 0.5 to 2 inches. Alternatively, the large aggregate base layer 30 is comprised of a substantially non-polymerized thermoplastic first bituminous concrete including relatively large aggregate as defined above, mixed with a liquid asphalt binder containing fractions of asphalts which are soluble in n-pentane, such as those described in U.S. Pat. No. 3,162,101; incorporated herein by reference. It is believed that the n-pentane soluble fractions of asphalts such as those described in U.S. Pat. No. 3,162,101 retard oxidation of the asphalt during heating, and thereby permit increased numbers of heating/softening cycles compared with conventional asphalt. Other oxidation retardants (or anti-oxidants) might also be used.

Any non-recycled thermoplastic large aggregate bituminous concrete may be used to form the large aggregate base layer 30. Preferably, a substantially heat-resistant thermoplastic large aggregate bituminous concrete is used to form the large aggregate layer 30. In accordance with the present invention, "heat-resistant" is defined as being repetitively softenable in response to repetitive applications of infrared radiation. Such materials are minimally damaged in thermoplasticity and are commonly described as being "recyclable." More preferably, a substantially heat-resistant thermoplastic virgin large aggregate bituminous concrete is used to form the large aggregate base layer 30. Most preferably, a substantially heat-resistant substantially non-polymerized thermoplastic large aggregate bituminous concrete mixed with ASTM D977 asphalt emulsion binder and preferably also containing n-pentane soluble fractions of asphalts such as those described in U.S. Pat. No. 3,162,101 which is capable of curing with or without heat treatment, such as large aggregate grade MARIMIX™, is used to form the large aggregate base layer 30. In accordance with the invention, the large aggregate bituminous concrete used to form the large aggregate base layer 30 is prepared by heating to about 300° F. prior to installation, overlapping region 20.

In this step of the method of the invention, for a 4.0 inch pavement, for example, the large aggregate layer 30 is first placed overlapping region 20 to a depth of preferably about 1 to about 3.5 inches. More preferably, the depth of the large aggregate layer 30 is about 1.5 to about 3 inches. Most preferably, the depth of the large aggregate layer 30 is formed in layers of about 2 to about 2.5 inches, said layers being placed to within 1.5 to 2.0 inches of the pavement surface. The large aggregate layer 30 is rough graded by luting or raking and mechanically compacted using known methods in layers not to exceed 2 inches in depth. The large aggregate base layer 30 may be further sealed by applying heated liquid asphalt materials, as is known in the art. Suitable sealant materials for use in the method of the invention comprise asphalt emulsions optionally containing n-pentane soluble fractions of asphalts, as disclosed, for example, in U.S. Pat. No. 3,162,101.

Figure 4:
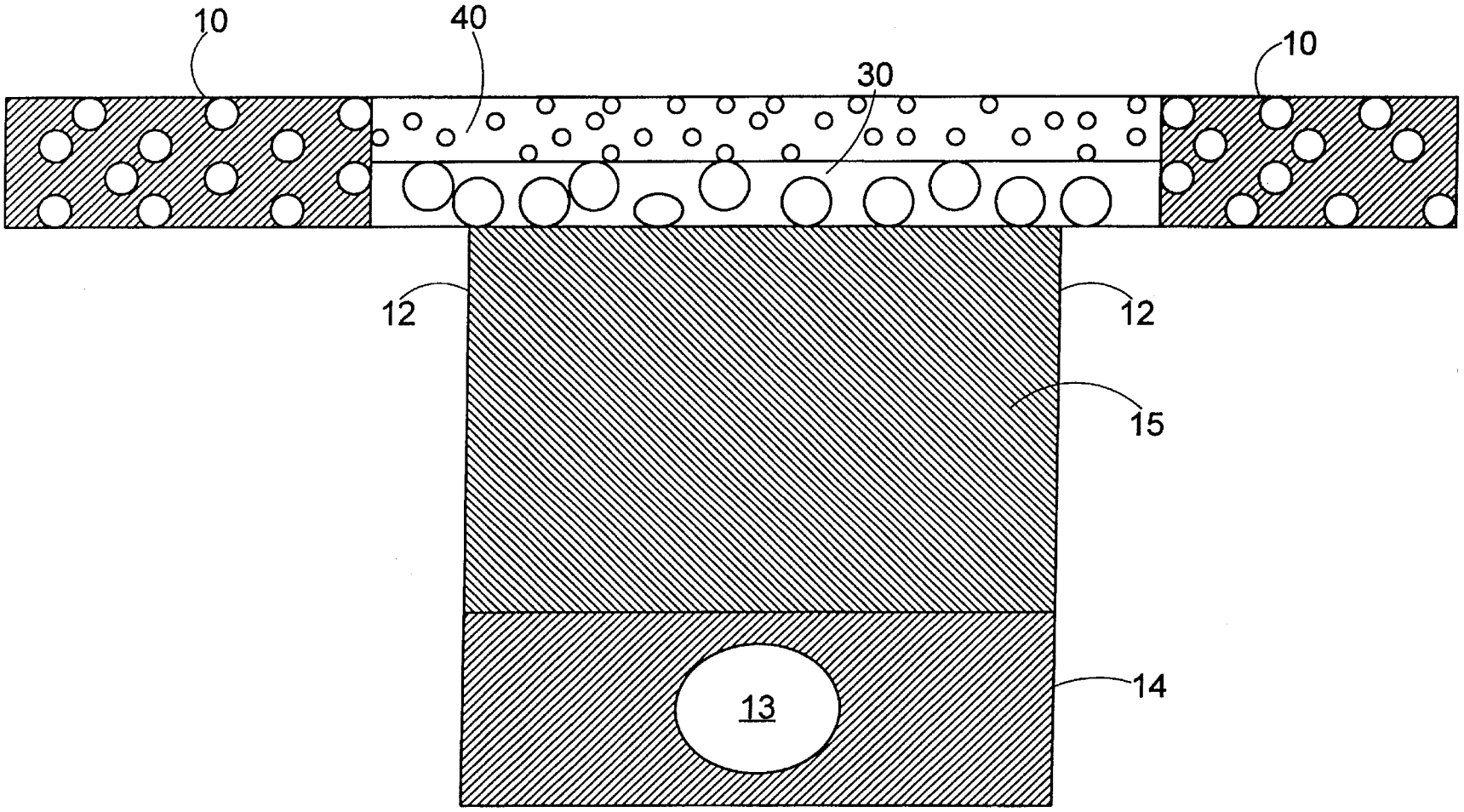
FIG. 4 shows a sectional view of the utility trench repaired in accordance with the invention, having both binder layer and surface layer applied.

FIG. 4 shows the third step of the method of the invention, in which a small aggregate surface layer 40 has been applied to the large aggregate base layer 30. The small aggregate surface layer 40 is comprised of a finer grade of a heated virgin bituminous concrete than the large aggregate layer 30, mixed with a liquid asphalt binder (asphalt cement, emulsified asphalt, or the like). The small aggregate layer 40 is comprised of virgin bituminous concrete including relatively small particles of stone, i.e., relatively small aggregate. In accordance with the invention, the small aggregate contains particles of stone having a maximum dimension less than 0.5 inch. Alternatively, the small aggregate surface layer 40 is comprised of a substantially non-polymerized thermoplastic second bituminous concrete including a relatively small aggregate (as defined above) mixed with a liquid asphalt binder containing fractions of n-pentane soluble asphalts such as those described in U.S. Pat. No. 3,162,101. Any non-recycled thermoplastic small aggregate bituminous concrete may be used to form the small aggregate surface layer 40. Preferably, a substantially heat-resistant thermoplastic small aggregate bituminous concrete is used to form the small aggregate surface layer 40. More preferably, a substantially heat-resistant thermoplastic virgin small aggregate bituminous concrete is used to form the small aggregate surface layer 40. Most preferably, a substantially heat-resistant substantially nonpolymerized thermoplastic small aggregate bituminous concrete mixed with ASTM 977 asphalt emulsion binder and preferably also containing n-pentane soluble fractions of asphalts such as those described in U.S. Pat. No. 3,162,101 which is capable of curing with or without heat treatment, such as small aggregate grade MARIMIX™, is used to form the small aggregate surface layer 40. In accordance with the invention, the small aggregate bituminous concrete used to form the small aggregate surface layer 40 is prepared by heating to about 300° F. prior to application to the large aggregate base layer 30.

In this step of the invention, an amount of small aggregate bituminous concrete is placed on the large aggregate base layer 30 which is sufficient to make the total depth of the patch, large aggregate base layer 30 plus small aggregate surface layer 40, not less than 4 inches, or the depth of the pavement, whichever is greater. After the small aggregate surface layer 40 is placed on the large aggregate base layer 30, the small aggregate base layer is finish graded by luring or raking, compacted by mechanical means, and constructed to be consistent with the adjacent and surrounding surface of the existing pavement. The small aggregate surface layer 40 may be further sealed by applying heated liquid asphalt sealant materials, as is known in the art, before and/or after installation. Suitable sealant materials for use in the method of the invention comprise asphalt emulsions optionally containing n-pentane soluble fractions of asphalts, as disclosed, in U.S. Pat. No. 3,162,101.

In accordance with the invention, additional large aggregate and small aggregate layers may be added to the patch, or additional grades of bituminous concrete may be added to form additional layers of the patch. The resulting uppermost layer may be reworked to re-establish the original surface plane of the roadway and thermally integrated by applying heat, preferably non-aspirated heat and more preferably infrared heat. Optionally, additional suitable bituminous concrete(s) may be introduced after the surface has been plasticized by the application of heat and scarified. The additional paving materials are reworked into the scarified area by finish raking or luting to the desired grade and by compacting the entire heated sections. A sealant material such as the n-pentane soluble fractions of asphalt described in U.S. Pat. No. 3,162,101, optionally mixed with compatible liquid asphalts, may be applied to the uppermost layer of the patch, and stone dust and mineral filler, or the like, may be added to minimize tracking. The perimeter between the patch and the pavement surface may also be sealed using a sealant material.

An asphaltic pavement patch made in accordance with the invention can be applied year round within 24 hours, at any ambient temperature, and because of the added strength of the bridging of the large aggregate and small aggregate layers, will not require re-excavation, needing only infrared heat treatment if the underlying subgrade has moved resulting in a surface irregularity and/or depression. Elimination of the need for reexcavation is environmentally desirable, resulting in a significant efficiencies and cost savings.

If additional processing of the pavement patch made in accordance with the invention is required, such processing may be made as described below. After a period of time has elapsed to allow for consolidation and/or movement of the underlying ground layers, the surface area containing the asphaltic pavement patch is heated together with the immediate adjacent pavement, to a depth of about one to one and one-half inches. The ultimate size of the heated area will correspond approximately to the dimensions of the area to be repaired and to that of the heater used. When a large patch is being processed, the processing is continuous and is performed in such a way that only small, overlapping areas are processed a section at a time, to allow surface thermal integration of the bituminous asphaltic materials of the patch and newly added bituminous asphaltic materials with the existing pavement.

Preparatory to the patch being heated, a compensating petroleum product such as the sealant described above may be applied to the pavement surface. The patch is then heated using a non-aspirated heat such as infrared heat. An additional application of the sealant material may be utilized after the pavement has been plasticized. The softened area may then be appropriately scarified, thoroughly mixing in the sealing mixtures, establishing the surface area requiring additional bituminous concrete. The heated virgin or substantially nonopolymerized bituminous concrete, which may comprise one or more additional small aggregate layers as described above, is added to the scarified area to compensate for any surface depression which may have occurred. This bituminous concrete is re-graded by finish raking or luring, and mechanically compacted, restoring the original surface plane of the pavement. Preferably, all additional bituminous concrete(s) are obtained from thermostatically controlled containers at the site. The edges of the patch are then sealed as set forth above, and a final application of the sealant material may be utilized to densify the entire heat treated surface area. In this way, a semi-permanent patch, which only requires further attention if, or when, a surface irregularity occurs, may be recycled into a permanent patch without re-excavation. This comprehensive system is environmentally responsive.

Figure 5:
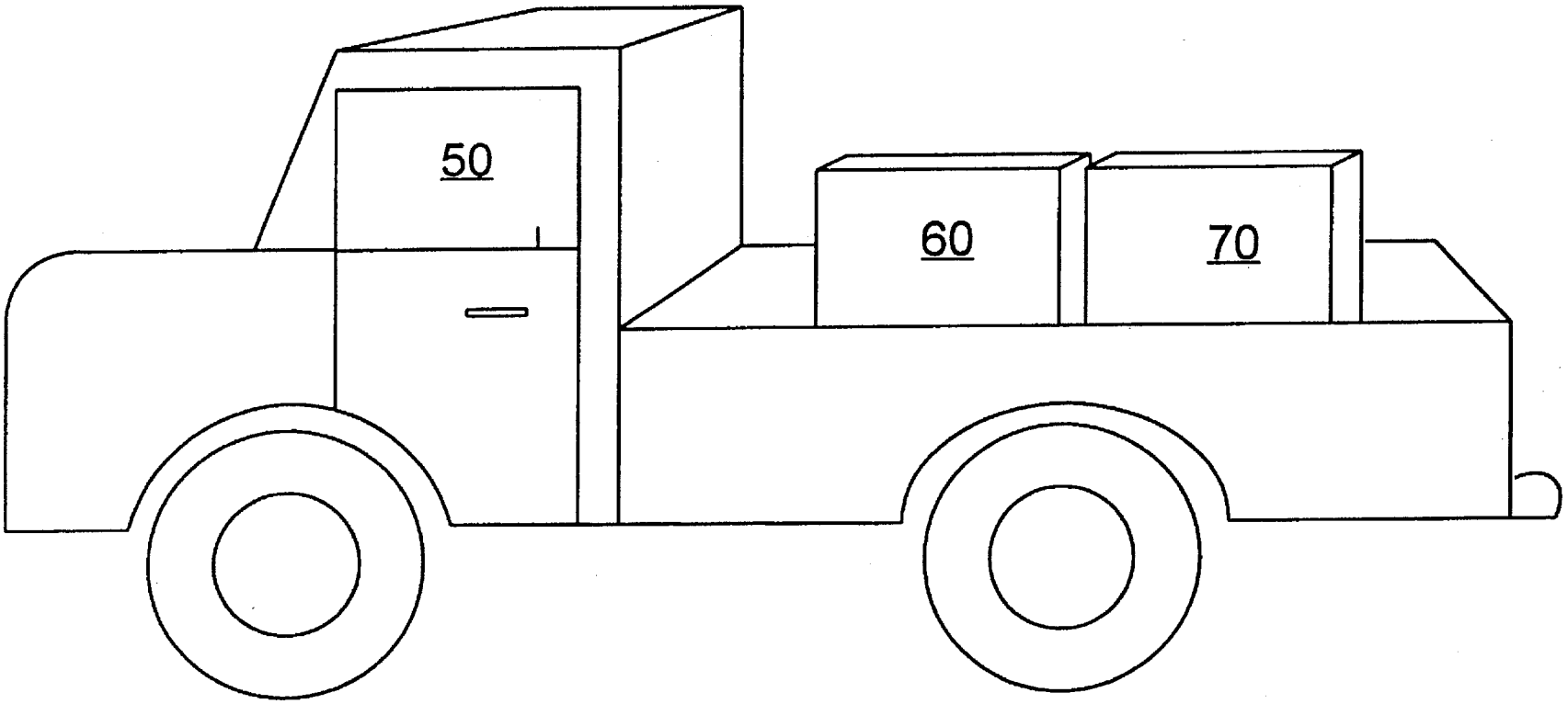
FIG. 5 shows a side view of the self-contained mobile unit of the invention.

FIG. 5 shows a self-contained mobile unit 50 used to practice the method of the invention. This unit contains two thermostatically controlled asphalt reclamation systems 60 and 70. Single asphalt reclamation systems are described in U.S. Pat. No. 4,445,848, incorporated herein by reference. The first reclamation system 70 is used in accordance with the invention to prepare and/or store the large aggregate bituminous concrete for application of the large aggregate layer by heating the large aggregate bituminous concrete to about 300° F. The second reclamation system 60 is used in accordance with the invention to prepare and/or store the small aggregate bituminous concrete for application of the small aggregate layer by heating the small aggregate bituminous concrete to about 300° F. The presence and capacity of the two asphalt reclamation systems on one mobile unit allows preparation and/or storage of the different grades of bituminous concrete which form the large and small aggregate layers of the patch to be delivered immediately to the sites of multiple backfilled trenches, which has not previously been possible. Of course, additional reclamation units can be added to the mobile unit of the invention if greater capacity or additional grades of bituminous concrete are used in accordance with the method of the invention. The self-contained mobile unit of the invention may additionally include miscellaneous apparatus such as compaction equipment, liquid asphalt sealants, hand tools, and the like.

Those of skill in the art will recognize that the invention may be embodied in other specific forms without departing from the spirit or essential characteristics thereof. The presently described embodiments are therefore to be considered in all respects as illustrative and not restrictive, the scope of the invention being indicated by the appended claims rather than by the foregoing description, and all variations of the invention which are encompassed within the meaning and range of equivalency of the claims are therefor intended to be embraced therein.

What is claimed is:

1. A method of repairing asphalt pavement over a trench containing backfill, and characterized by a peripheral wall defining the trench, comprising the steps of:

a. cutting back the pavement to provide a region overlying the trench and extending beyond the peripheral wall;

b. applying at least one large aggregate layer in said region to establish a set of one or more large aggregate layers, said set having an uppermost layer, whereby the peripheral wall of the trench is bridged;

c. applying at least one small aggregate layer overlying the uppermost large aggregate layer to establish a set of one or more small aggregate layers, said set having an uppermost layer; and d. applying heat to at least one of said uppermost layers;

said large aggregate layer being a heated virgin first bituminous concrete including relatively large aggregate mixed with a liquid asphalt binder, or a substantially non-polymerized thermoplastic first bituminous concrete including relatively large aggregate mixed with a liquid asphalt binder containing n-pentane soluble fractions of asphalts and being repetitively softenable in response to repetitive applications of infrared radiation, and said small aggregate layer being a heated virgin second bituminous concrete including a relatively small aggregate mixed with a liquid asphalt binder, or a substantially non-polymerized thermoplastic second bituminous concrete including a relatively small aggregate mixed with a liquid asphalt binder containing n-pentane soluble fractions of asphalts and being repetitively softenable in response to repetitive applications of infrared radiation, whereby a patch is formed in said pavement.

2. The method of claim 1, wherein the first and second bituminous concretes are heated virgin bituminous concrete.

3. The method of claim 1, wherein the first and second bituminous concretes are fractions of substantially non-polymerized thermoplastic bituminous concrete mixed with a liquid asphalt binder, containing n-pentane soluble fractions of asphalts and being softenable in response to repetitive applications of infrared radiation.

4. The method of claim 1, wherein the relatively large aggregate contains stone having a maximum dimension in the range of 0.5 to 2 inches, and the relatively small aggregate contains stone having a maximum dimension of less than 0.5 inches.

5. The method of any of claims 1, 2, 3, or 4, comprising the further step of applying a sealant material to at least one of said layers.

6. The method of claim 5, wherein the sealant material comprises a heated liquid asphalt.

7. The method of any of claims 1, 2, 3, or 4, comprising the further step, during or after said application of heat, of adding additional aggregate and asphalt binder.

8. The method of claim 7, comprising the further step of applying a sealant material to at least one of said layers.

9. The method of claim 8, wherein the sealing material comprises a heated liquid asphalt.

10. The method of any of claims 1, 2, 3, or 4, wherein steps a through c occur within 24 hours.

11. The method of any of claims 1, 2, 3, or 4, wherein the backfill comprises compacted gravel.

12. The method of any of claims 1, 2, 3, or 4, wherein the backfill comprises soil cement.

13. The method of any of claims 1, 2, 3, or 4, comprising the further steps of:

e. heating the uppermost portion of said patch;

f. applying at least one additional small aggregate layer to said uppermost portion;

g. heating, grading, and compacting said additional small aggregate layers; and h. applying a sealant material to the surface of said additional small aggregate layers.

* * * * *